US010340621B2

(12) United States Patent
Hirota et al.

(10) Patent No.: US 10,340,621 B2
(45) Date of Patent: Jul. 2, 2019

(54) CONNECTOR WITH MOVING PLATE HAVING PARTITION BETWEEN TERMINALS TO PREVENT SHORT-CIRCUIT

(71) Applicant: Sumitomo Wiring Systems, Ltd., Yokkaichi, Mie (JP)

(72) Inventors: Masanori Hirota, Mie (JP); Yuji Kitagawa, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/953,536

(22) Filed: Apr. 16, 2018

(65) Prior Publication Data

US 2018/0309223 A1 Oct. 25, 2018

(30) Foreign Application Priority Data

Apr. 21, 2017 (JP) ..... 2017-084180

(51) Int. Cl.

| | |
|---|---|
| ***H01R 13/44*** | (2006.01) |
| ***H01R 13/453*** | (2006.01) |
| ***H01R 13/41*** | (2006.01) |
| *H01R 13/629* | (2006.01) |
| *H01R 13/04* | (2006.01) |
| *H01R 13/422* | (2006.01) |

(52) U.S. Cl.

CPC ..... *H01R 13/4538* (2013.01); *H01R 13/41* (2013.01); *H01R 13/04* (2013.01); *H01R 13/4223* (2013.01); *H01R 13/62938* (2013.01)

(58) Field of Classification Search

CPC ..... H01R 13/453; H01R 13/4538

USPC ..... 439/595, 752, 141, 157, 372

See application file for complete search history.

(56) References Cited

U.S. PATENT DOCUMENTS 5,501,606 A * 3/1996 Oda ..... H01R 13/631 439/140
7,134,901 B2 * 11/2006 Okura ..... H01R 13/4538 439/372
7,722,414 B2 * 5/2010 Tanaka ..... H01R 13/4365 439/595

FOREIGN PATENT DOCUMENTS

JP 2016-115461 6/2016

* cited by examiner

*Primary Examiner* — Phuong K Dinh
(74) *Attorney, Agent, or Firm* — Gerald E. Hespos; Michael J. Porco; Matthew T. Hespos

(57) ABSTRACT

A housing (10) includes a housing body (11) and a receptacle (12) projecting forward from the housing body (11). The housing body (11) includes first cavities (13) into which first male terminals (70) are inserted, and second cavities (14) into which second male terminals (80) are inserted. Each second male terminal (80) includes a second tab (82) longer than a first tab (72) of each first male terminal (70). Recesses (23) are provided on a front surface (17) of the housing body (11) around openings of the second cavities (14) and are recessed farther rearward than areas around openings of the first cavities (13). A moving plate (40) is movable from an initial position to a connection position in the receptacle (12). The moving plate (40) has interpolar partitioning portions (52) configured to partition between the adjacent second tabs (82) by entering the recesses (23) at the connection position.

7 Claims, 10 Drawing Sheets

CONNECTOR WITH MOVING PLATE HAVING PARTITION BETWEEN TERMINALS TO PREVENT SHORT-CIRCUIT

BACKGROUND

Field of the Invention

The invention relates to a connector.

Related Art

Japanese Unexamined Patent Publication No. 2016-115461 discloses a connector with a block-shaped terminal accommodating portion, a tubular receptacle projecting forward from the terminal accommodating portion and a moving plate arranged in the receptacle and configured to move from an initial position to an end position by being pressed by a mating female housing. The terminal accommodating portion and the receptacle constitute an integral male housing. The terminal accommodating portion has cavities to accommodate male terminals, and tabs of the male terminals project into the receptacle. The moving plate includes a plate body for covering the terminal accommodating portion from the front, and positioning holes penetrate the plate body for receiving and positioning the tabs. The tabs project farther forward from the positioning holes as the moving plate moves toward the end position and thus the tabs connected to mating female terminals. The moving plate maintains the tabs in a predetermined posture in the receptacle.

The tabs of the male terminals may differ in length. In this situation, a recess has been formed in the front surface of the terminal accommodating portion and the long tabs project from the back surface of the recess to reduce positional deviations of the tips of the tabs. However, a clearance is formed between the plate body and the back surface of the recess when the moving plate reaches the end position and the plate body faces contacts the front surface of the terminal accommodating portion. Thus, exposed areas of the adjacent long male terminals may be shorted to each other via the clearance.

Japanese Unexamined Patent Publication No. 2016-115461 fits interpolar blocking portions into fitting recesses on the front surface of the terminal accommodating portion. However, the interpolar blocking portions are provided on the mating female housing and the tabs do not project from the back surfaces of the fitting recesses. Thus, even with this approach, adjacent long male terminals still may be shorted to each other.

The invention was completed on the basis of the above situation and aims to provide a connector capable of avoiding a short circuit of adjacent male terminals when there are male terminals of different lengths.

SUMMARY

The invention relates to a connector with first male terminals each including a first tab, second male terminals each including a second tab. The second tabs are longer than the first tabs. The connector further includes a housing body with an array of adjacent first cavities for accommodating the first male terminals, and an array of adjacent second cavities for accommodating the second male terminals. Front ends of each first cavity and each second cavity are open at a front surface of the housing body. A tubular receptacle projects forward from the housing body and is configured to surround the first and second tabs projecting forward from the front surface. A mating housing can fit into the receptacle. The connector further has a moving plate with a plate body to cover the front surface from the front in the receptacle. The plate body has first and second holes through which the respective first and second tabs are inserted. The moving plate is configured to move toward the front surface from an initial position to a connection position by being pressed by the mating housing. A recess is formed in the front surface of the housing body around openings of the respective second cavities and is recessed farther rearward than areas around openings of the respective first cavities. An interpolar partitioning portion is provided on the moving plate and is configured to partition between the adjacent second tabs by entering the recess at the connection position.

The recess is provided in the front surface of the housing body and recesses the areas around the openings of the second cavities farther rearward than the areas around the openings of the first cavities. Thus, the adjacent second tabs that project into the recess may be shorted to each other. However, the interpolar partitioning portion of the moving plate enters the recess at the connection position to partition between the adjacent second tabs so that the second tabs are not shorted to each other.

The interpolar partitioning portion may project on a rear surface of the plate body. Thus, the interpolar partitioning portion is reinforced by the tubular portion and breakage is prevented. Further, the inner surfaces of the second holes and of the tubular portion are continuous. Therefore, insertion areas for the second tabs become longer and positioning reliability can be enhanced.

The tubular portion may be a continuous tube continuously surrounding the opening peripheral parts of the adjacent second holes on the rear surface of the plate body. Thus, the interpolar partitioning portion is reinforced by the continuous tubular portion.

First guiding portions may be provided on two opposed surfaces of the tubular portion and may expand from an intermediate position in the front-rear direction toward a rear end and second guiding portions may be provided on the other two opposed surfaces and may expand from a front end of the second hole toward an intermediate position in the front-rear direction. Thus, when inserting the second tab into the second hole, a two-stage guiding structure composed of the first and second guiding portions can be realized, utilizing the inner surface of the tubular portion. As a result, an impact force (stress) received by the second tab at the time of insertion into the second hole can be dispersed and alleviated.

The housing body may have one or more second locking lances configured to position (particularly retain and lock) the second male terminals by at least partly projecting into the respective second cavities. The plate body may have second tool insertion holes for passage of a tool to displace (unlock) the second locking lances from the second male terminals.

One or more cuts may be provided on an outer surface of the tubular portion and may communicate with the second tool insertion holes. The tool can contact and support the tubular portion via the cut, thereby ensuring necessary strength when the locking lance is being unlocked.

A slope may be provided near an opening edge part of the second cavity and may be inclined rearward toward an outer side.

These and other objects, features and advantages of the invention will become more apparent upon reading the following detailed description of preferred embodiments and accompanying drawings. It should be understood that even though embodiments are described separately, single features thereof may be combined to additional embodiments.

DETAILED DESCRIPTION

Figure 1:
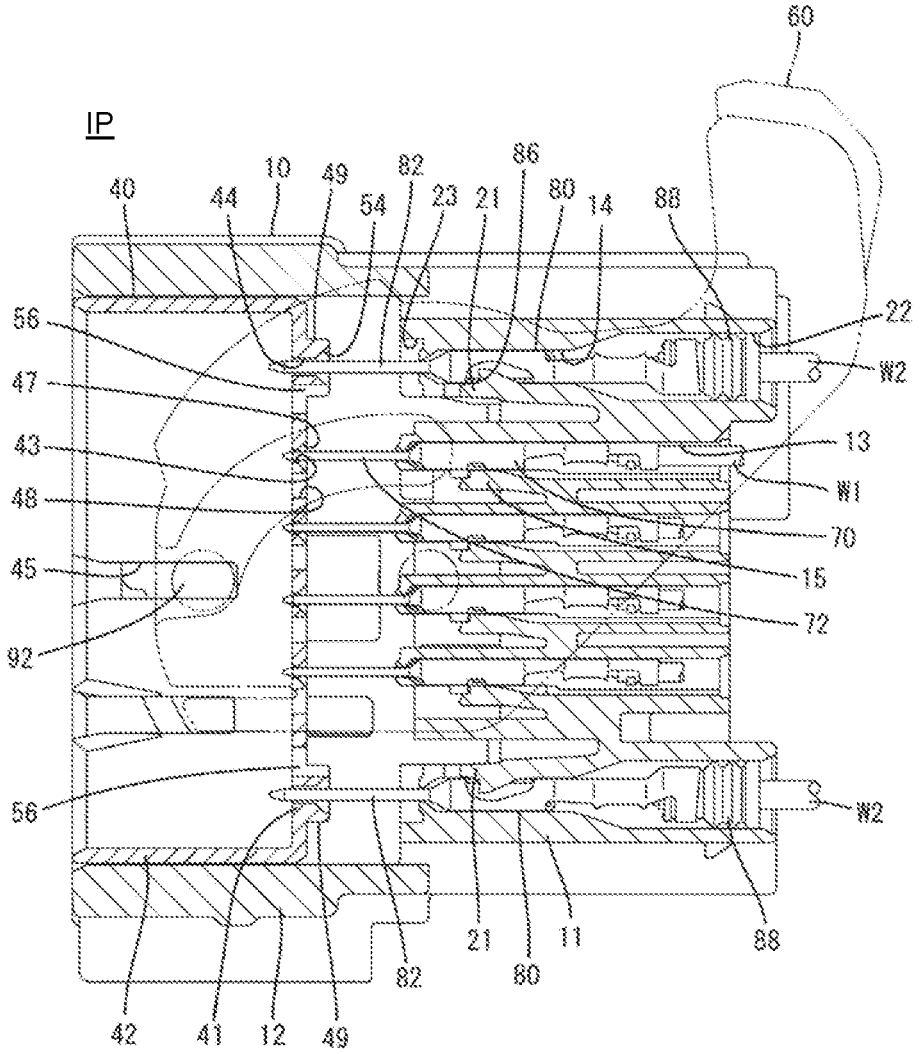
FIG. 1 is a side view in section showing a state where a moving plate is arranged at an initial position in a receptacle in a connector according to one embodiment of the present invention.

A connector according to an embodiment of the invention is described with reference to FIGS. 1 to 10. The connector according to this embodiment includes a housing 10, a moving plate 40, a lever 60, first male terminals 70 and second male terminals 80. The housing 10 is connectable to a mating housing 90. Note that, in the following description, a surface of the housing 10 facing the mating housing 90 at the start of connection is referred to as a front concerning a front-rear direction, and a vertical direction is based on FIGS. 1 and 2.

Figure 2:
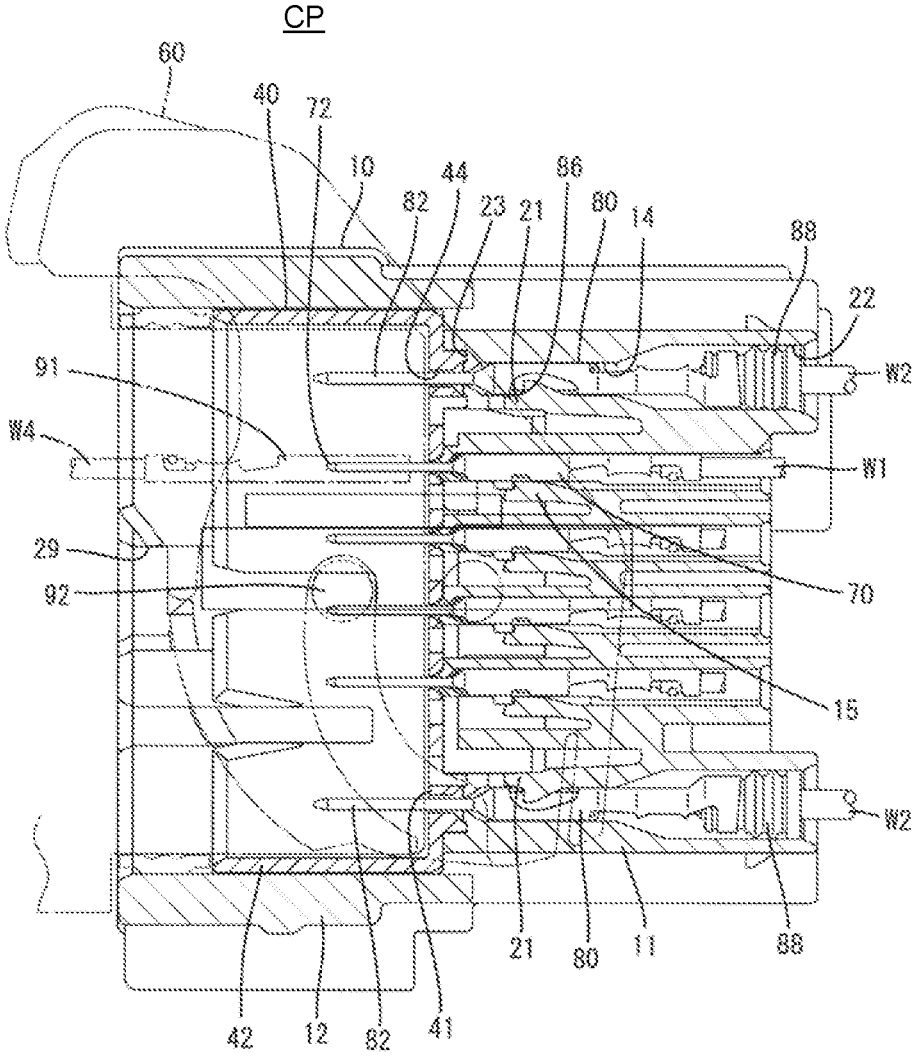
FIG. 2 is a side view in section showing a state where the moving plate is at a connection position.
Figure 3:
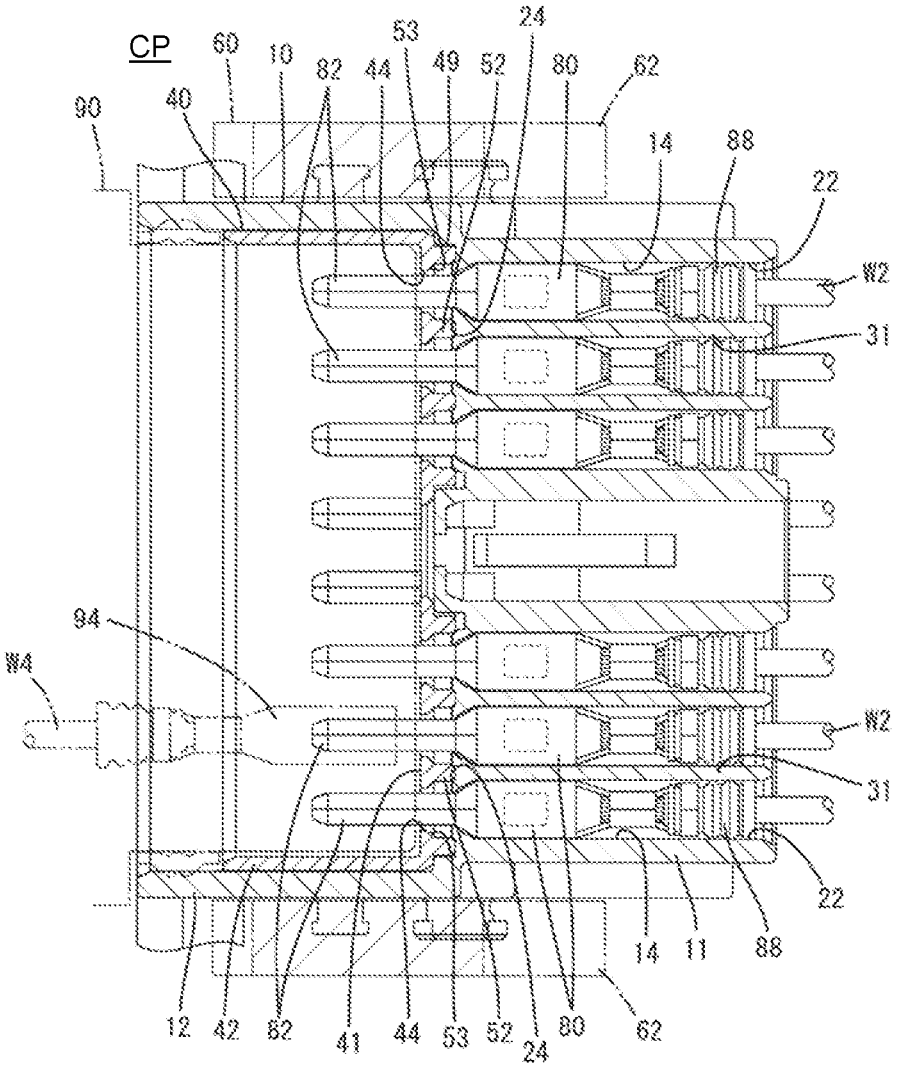
FIG. 3 is a plan view in section showing the state where the moving plate is at the connection position.

The mating housing 90 is made e.g. of synthetic resin and is in the form of a block. Small and large female terminals 91, 94 are accommodated in the mating housing 90, as shown in FIGS. 2 and 3. Cam followers 92 project on both left and right side surfaces of the mating housing 90. The female terminals 91, 94 are connected to end parts of wires W3, W4.

Figure 10:
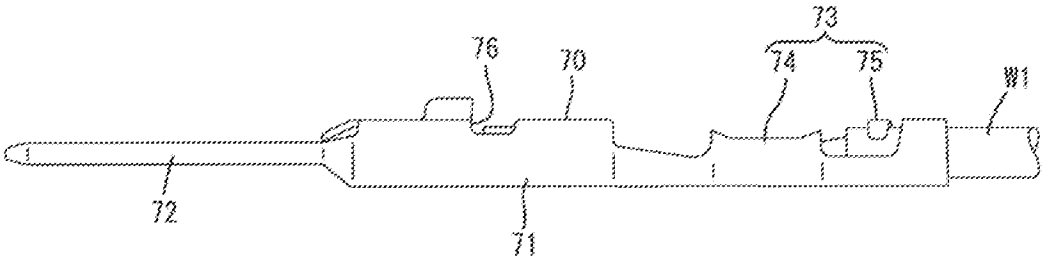
FIG. 10 is a side view of a first male terminal connected to a wire.

The first male terminal 70 is formed unitarily or integrally by folding, bending and/or embossing a conductive metal plate and is long and narrow in the front-rear direction, as shown in FIG. 10. The first male terminal 70 has a tubular first terminal body 71, a first tab 72 projecting forward from the first terminal body 71 and a first barrel 73 connected to and behind the first terminal body 71. The first barrel 73 is to be connected electrically to a wire W1 and comprises at least one first wire barrel 74 to be crimped, bent or folded and connected to a core exposed by removing a coating at an end part of the wire W1 and at least one first insulation barrel 75 arranged behind the first wire barrel portion 74 and to be crimped to the coating at the end part of the wire W1. A first lance receiving portion 76 is open in a peripheral wall of the first terminal body 71.

Figure 9:
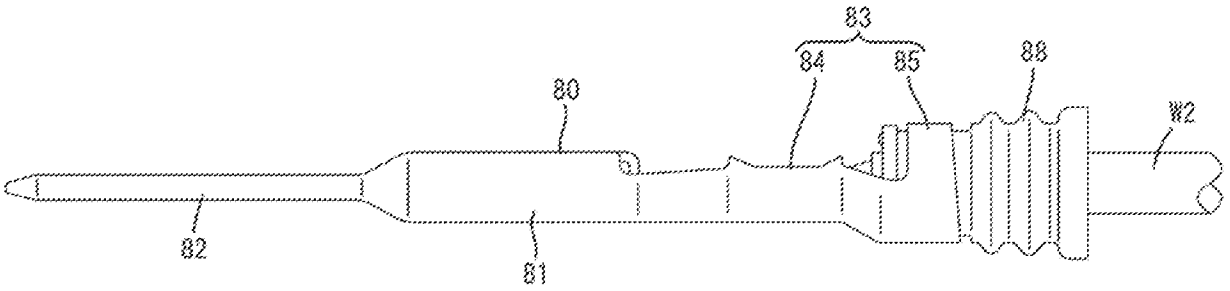
FIG. 9 is a side view of a second male terminal connected to a wire.

The second male terminal 80 also is formed unitarily or integrally by folding, bending and or embossing a conductive metal plate and is shaped to be long and narrow in the front-rear direction, as shown in FIG. 9. The second male terminal 80 is larger than the first male terminal 70 and longer in the front-rear direction than the first male terminal 70. Specifically, the second male terminal 80 includes a second terminal body 81, a second tab 82 and a second barrel 83 similar to the first male terminal 70. The second barrel 83 is to be connected electrically to a wire W2 and comprises at least one second wire barrel 84 to be crimped, bent or folded and connected to a core exposed by removing a coating at an end part of the wire W2 and at least one second insulation barrel 85 arranged behind the second wire barrel 84 and to be crimped, bent or folded to a resilient (e.g. rubber) plug 88 externally fit on the coating at the end part of the wire W2. A second lance receiving portion 86 is open in a peripheral wall of the second terminal body 81 (see FIG. 1).

Figure 5:
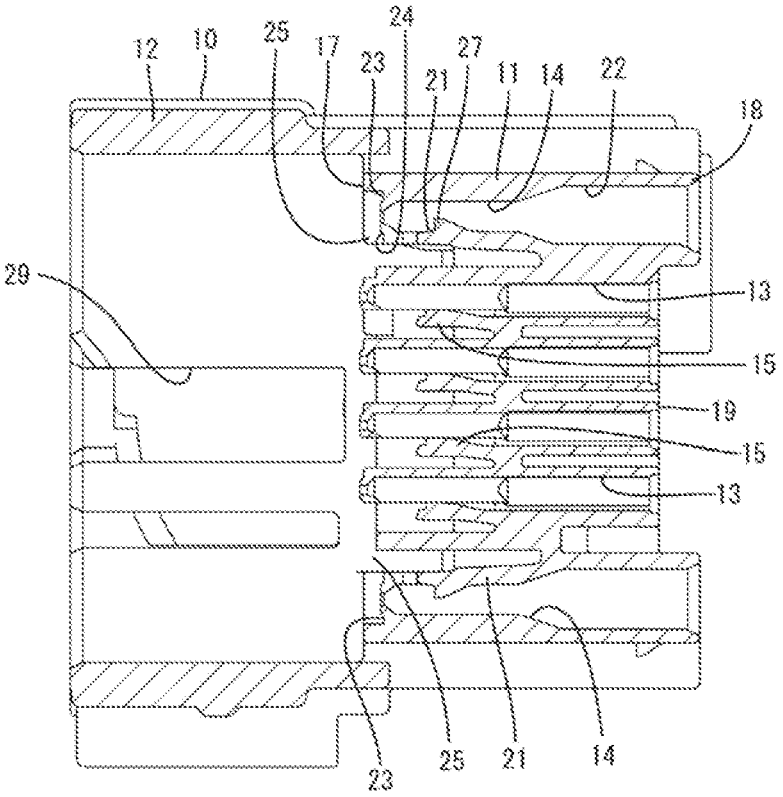
FIG. 5 is a side view in section of a housing.
Figure 6:
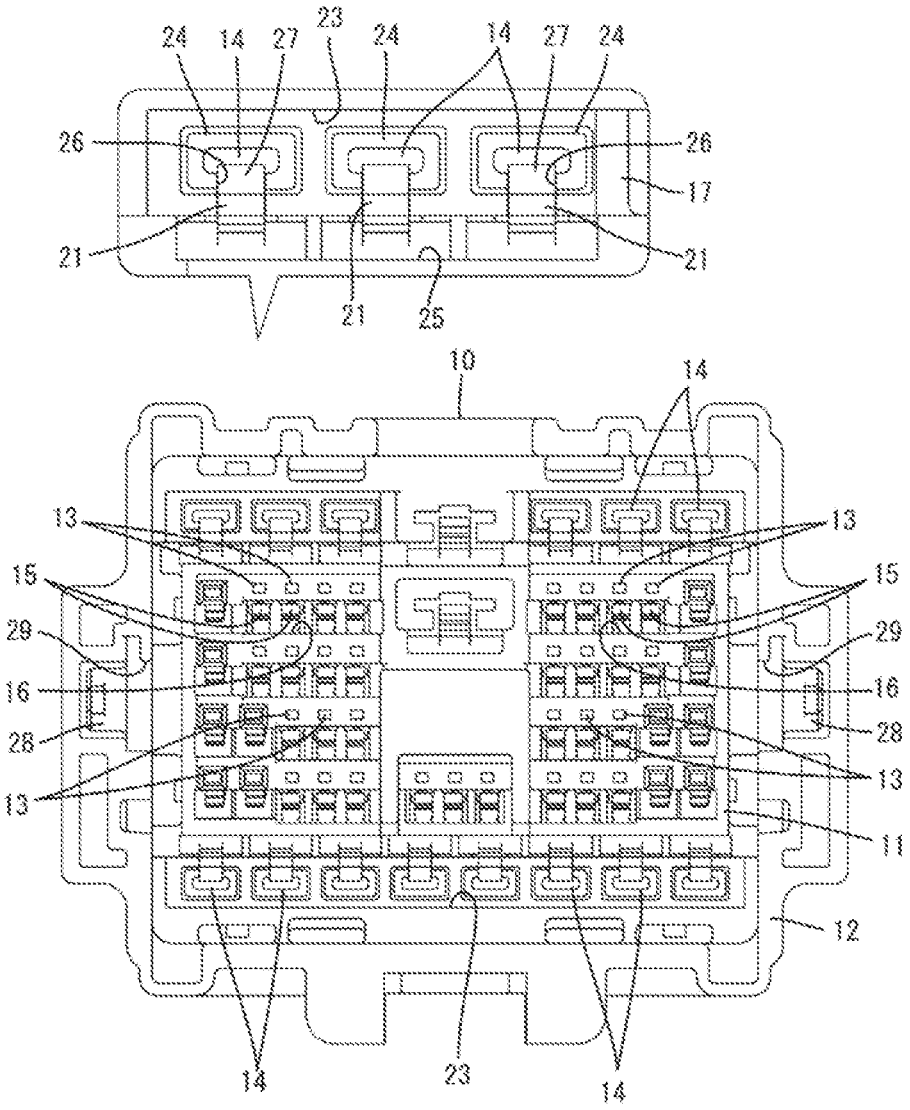
FIG. 6 is a front view of the housing.

The housing 10 is made of synthetic resin and includes, as shown in FIGS. 5 and 6, a housing body 11 substantially in the form of a rectangular block and a receptacle 12 substantially in the form of a rectangular tube integrally projecting forward from an outer peripheral part of the front end of the housing body 11. The mating housing 90 and the moving plate 40 fir in the receptacle 12.

The housing body 11 includes first cavities 13 aligned in the vertical and lateral directions in an area excluding both upper and lower end parts and a laterally central upper part and second cavities 14 aligned in the lateral direction in upper and lower end parts (excluding the laterally central upper part). Each first cavity 13 extends in the front-rear direction and is open in a front surface portion 17 and a rear surface portion 18 of the housing body 11. A projecting base end part of each first tab 72 is arranged in each cavity 13 in the front surface portion 17 of the housing body 11.

A deflectable first locking lance 15 projects forward at an inner surface of each first cavity 13. The first male terminal 70 is inserted into each first cavity 13 from behind and is held in the first cavity 13 by the first locking lance 15 being fit and locked to the first lance receiving portion 76.

The front end of each first cavity 13 is open in the front surface 17 of the housing body 11 to have a rectangular cross-section, and first openings 16 for opening front parts of the respective first locking lances 15 are provided below the respective first cavities 13. The first opening 16 also communicates with spaces between the first locking lances 15 adjacent in the lateral direction (width direction) and is open long in the lateral direction.

As shown in FIG. 5, an opening area of the respective first cavities 13 in the rear surface 18 of the housing body 11 is formed into a recessed surface 19 slightly recessed farther forward than both upper and lower end parts. An unillustrated one-piece rubber plug is held in close contact with the recessed surface 19. Thus, the wires W1 connected to the first male terminals 70 are waterproofed around by the one-piece rubber plug.

Similar to each first cavity 13, each second cavity 14 extends in the front-rear direction and is open in the front and rear surfaces 17 and 18 of the housing body 11, and a deflectable second locking lance 21 projects forward at an inner surface. A projecting base end of each second tab 82 is arranged in an opening of each cavity 14 in the front surface portion 17 of the housing body 11.

The second male terminal 80 is inserted into each second cavity 14 from behind. The second male terminal 80 is held in the second cavity 14 by fitting and locking the second locking lance 21 to the second lance receiving portion 86.

As shown in FIG. 5, each second cavity 14 is radially larger and longer in the front-rear direction than each first cavity 13. A rear part of each second cavity 14 has a larger vertical opening than a front part and serves as a sealing portion 22 into which the rubber plug 88 fit on the second male terminal 80 is inserted in a liquid-tight manner (see FIG. 2). The second locking lance 21 projects forward from the sealing portion 22 and is larger than the first locking lance 15.

Opening areas of the second cavities 14 in the rear surface 18 of the housing body 11 project farther rearward than the recessed surface 19 (opening area of the respective first cavity 13) at both upper and lower ends.

On the other hand, opening areas of the second cavities 14 in the front surface 17 of the housing body 11 are recessed slightly farther rearward than the opening area of the first cavities 13 at both upper and lower end parts. As shown in FIG. 5, the upper and lower end parts of the front surface 17 of the housing body 11 are configured as recesses 23 recessed farther rearward than the opening area of the respective first cavities 13. As shown in FIG. 6, the recess 23 also communicates with areas between the second cavities 14 adjacent in the lateral direction and is open long in the lateral direction. No recess 23 is provided on partition walls 31 (see FIG. 3) partitioning between the respective second cavities 14 in the lateral direction. By providing the recesses 23 in the front surface 17 of the housing body 11, the projecting base end of each second tab 82 is located behind the projecting base end of each first tab 72 and the projecting tips of the first and second tabs 72 and 82 and each first tab 72 substantially align in the front-rear direction, as shown in FIGS. 1 and 2.

The front ends of the second cavities 14 are open in the back surfaces of the recesses 23 (both upper and lower end parts of the front end part of the housing body 11) to have a wide rectangular cross-section, as shown in FIG. 6, and a slope 24 inclined rearward toward an outer side is provided on an opening edge of each second cavity 14, as shown in FIG. 5.

Further, second openings 25 for opening a front part of each second locking lance 21 are provided in the front surface 17 of the housing body 11. As shown in FIG. 6, the second opening 25 also communicates with spaces between the second locking lances 21 adjacent in the lateral direction (width direction) and is open long in the lateral direction. A communicating portion 26 is provided on one side of each slope 24 by partly cutting off the second opening portion 25, and a locking projection 27 of each second locking lance 21 can be confirmed visually through each communicating portion 26.

As shown in FIG. 6, two support shafts 28 project on both left and right outer surfaces of the housing 10. The lever 60 is supported rotatably on each support shaft 28. Two forwardly open introducing grooves 29 are provided before the respective support shafts 28 on both left and right side walls of the receptacle 12 and extend in the front-rear direction. Each cam follower 92 of the mating housing 90 is inserted into and guided by each introducing groove 29.

Figure 4:
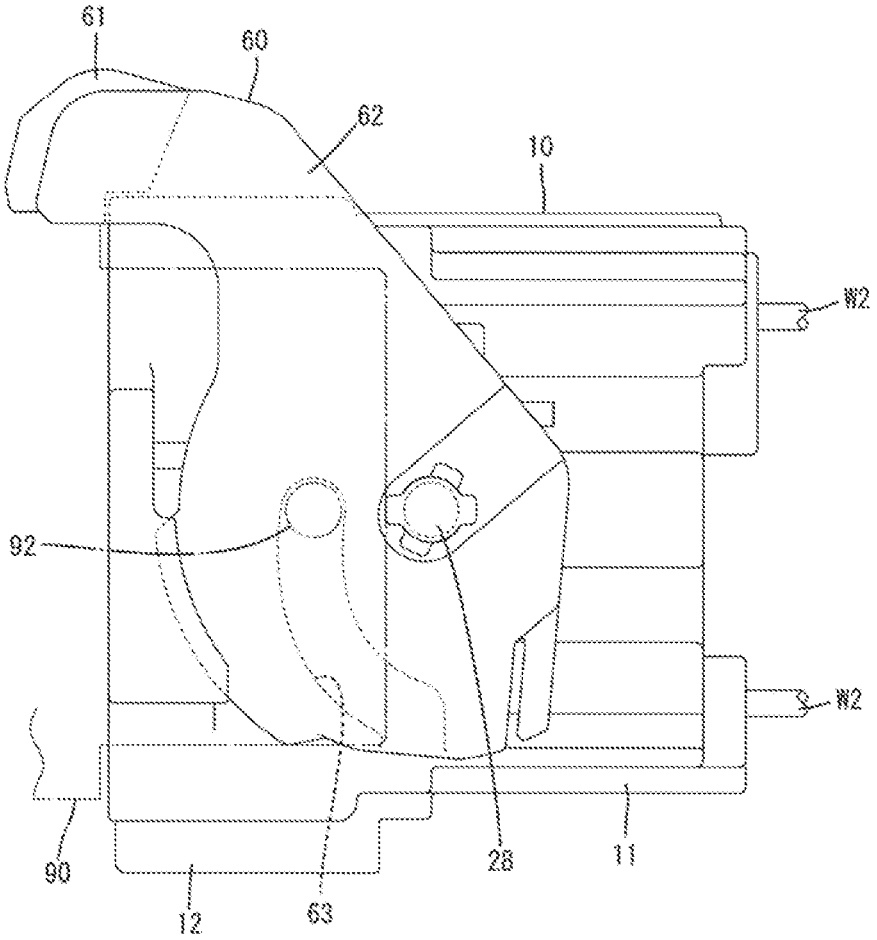
FIG. 4 is a side view of the connector.

The lever 60 is made of synthetic resin and defines a U-shape with an operating portion 61 extending along the lateral direction and two cam portions 62 (only one is shown in FIG. 4) projecting from both left and right end parts of the operating portion 61, as shown in FIG. 4. Each cam portion 62 includes a bearing part for receiving the corresponding support shaft 28 and a cam groove 63 extending in a predetermined direction and open on an outer peripheral edge. The lever 60 is mounted to straddle the housing 10 and is rotatable about the respective support shafts 28.

Figure 7:
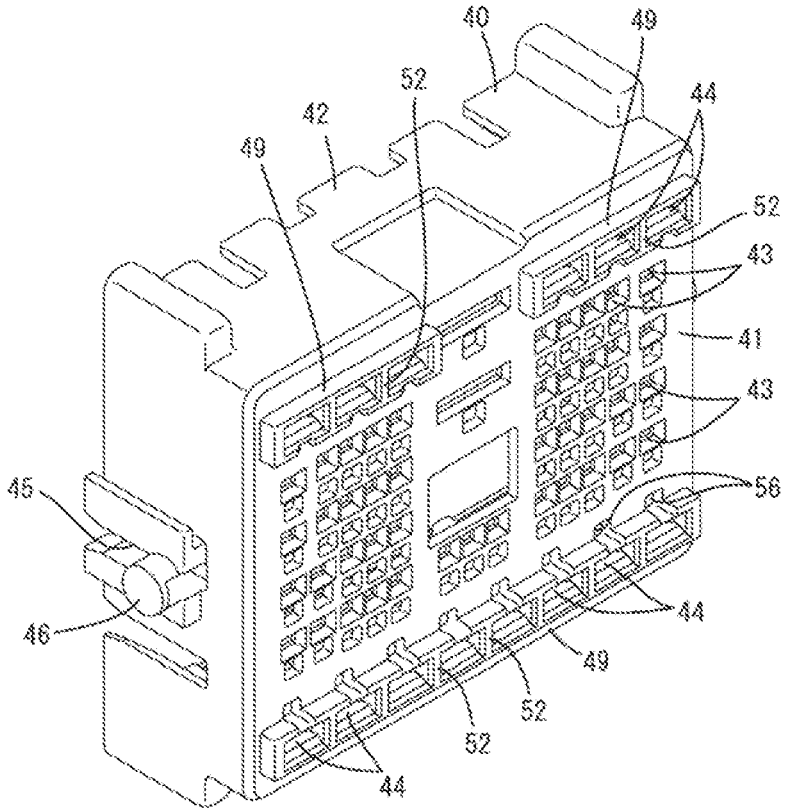
FIG. 7 is a perspective view of the moving plate.

The moving plate 40 is made e.g. of synthetic resin in the form of a forwardly open cap and includes a plate body 41 in the form of a flat plate extending along the vertical direction and a peripheral wall 42 substantially in the form of a rectangular tube integrally projecting forward from an outer peripheral part of the plate body 41, as shown in FIG. 7.

The plate body 41 covers the front surface 17 of the housing body 11 in the receptacle 12 and includes first holes 43 at positions corresponding to the respective first cavities 13 and second holes 44 at positions corresponding to the respective second cavities 14. Each first hole 43 has a rectangular cross-section corresponding to each first tab 72 and each first tab 72 is positioned inside. Each second hole 44 has a wide rectangular cross-section corresponding to each second tab 82 and each second tab 82 is positioned inside.

Two forwardly open entrance grooves 45 are provided on both left and right side walls of the peripheral wall 42 and extend in the front-rear direction. Two U-shaped pin receiving portions 46 straddle a rear opening part of each entrance groove 45.

The moving plate 40 is movable in the receptacle 12 from an initial position IP (see FIG. 1) where the plate body 41 is separated forward from the front surface 17 to a connection position CP (see FIGS. 2 and 3) where the plate body 41 is almost in contact with the front surface 17. In a state where the moving plate 40 is arranged at the initial position IP and entrances of the cam grooves 63 of the lever 60 are facing forward, each pin receiving portion 46 is inserted into the entrance of each cam groove 63 via each introducing groove 29. In that state, the mating housing 90 is fit shallowly into the receptacle 12, and each cam follower 92 is fit into each pin receiving portion 46 via the introducing groove 45. The lever 60 then is rotated, and each pin receiving portion 46 is pressed by each cam follower 92 to slide on a groove surface of each cam groove 63. Thus, a cam action is exhibited between the lever 60 and the mating housing 90 and a connecting operation of the housings 10, 90 proceeds.

As shown in FIG. 1, when the moving plate 40 is at the initial position IP, the projecting tip of each first tab 72 is positioned in each first hole 43 and the projecting tip of each second tab 83 is positioned in each second hole 44. As the moving plate 40 moves toward the connection position CP, each first tab 72 and each second tab 82 project significantly forward from each first hole 43 and each second hole 44 and, as shown in FIGS. 2 and 3, are connected to the corresponding female terminals 91, 94 accommodated in the mating housing 90. In this case, each first tab 72 and each second tab 82 are protected by the moving plate 40 in the receptacle 12 and can maintain a straight posture.

Figure 8:
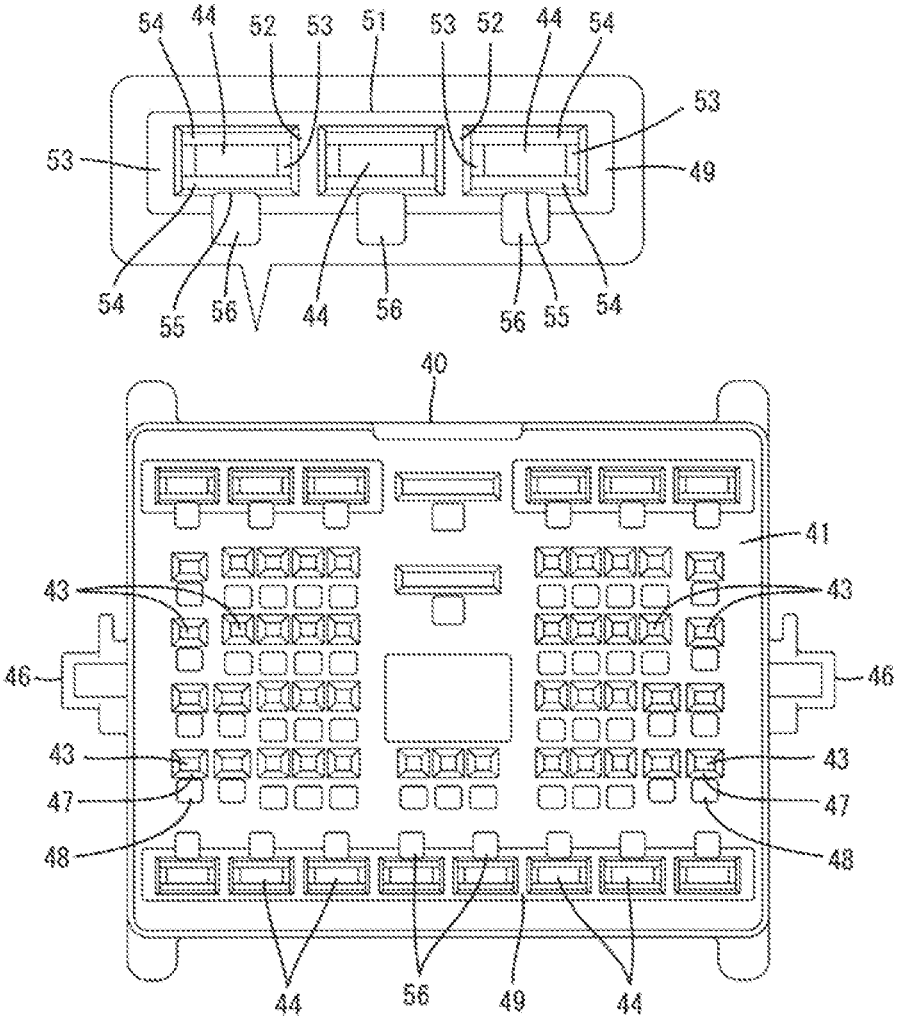
FIG. 8 is a front view of the moving plate.

As shown in FIGS. 1 and 8, a guiding portion 47 is provided on the inner surface of each first hole 43 and conically expands from an intermediate position of the plate body 41 in the front-rear direction (thickness direction) to the rear surface of the plate body 41. Further, the plate body 41 is provided with first tool insertion holes 48 below the respective first holes 43.

Tubular portions 49 are provided on both upper and lower end parts of the rear surface of the plate body 41 and project rearward from opening peripheral parts of the respective second holes 44. As shown in FIG. 8, the tubular portion 49 includes a surrounding portion 51 substantially in the form of a wide rectangular tube for collectively surrounding the opening peripheral parts of the respective second holes 44 adjacent in the lateral direction on the rear surface of the plate body 41 and interpolar partitioning portions 52 are arranged between the second holes 44 that are adjacent in the lateral direction and form a wide continuous tube. The interpolar partitioning portion 52 is a vertical wall and both upper and lower ends thereof are coupled integrally to the surrounding portion 51. The inner surface of the tubular portion 49 has a wide rectangular cross-section for each second hole 44 and is connected coaxially to the inner surface of each second hole 44, as shown in FIGS. 1 and 3.

As shown in FIG. 3, succeeding guiding portions 53 are provided on both left and right sides of the inner surface of each second hole 44 and conically expand from an intermediate position of the plate body 41 in the front-rear direction (thickness direction) to the rear surface of the plate body 41. The upper and lower sides of the inner surface of each second hole 44 are arranged substantially horizontally along the front-rear direction and not expanded.

On the other hand, preceding guiding portions 54 are provided on both upper and lower sides of the inner surface of the tubular portion 49, as shown in FIG. 1, and conically expand from an intermediate position of the tubular portion 49 in the front-rear direction to the rear surface of the tubular portion 49. Ranges from both upper and lower sides of the inner surface of the second hole 44 to the intermediate position of the tubular portion 49 in the front-rear direction are arranged substantially horizontally without any step. Further, as shown in FIG. 3, both left and right sides of the inner surface of the tubular portion 49 are arranged substantially horizontally along the front-rear direction except at chamfered parts on a rear end side and are not expanded. A separation distance between the left and right sides of the inner surface of the tubular portion 49 is larger than a lateral dimension of the second tab 82.

Further, the plate body 41 is provided with second tool insertion holes 56 below the respective second holes 44. The second tool insertion holes 56 are at positions corresponding to the respective second locking lances 21, as shown in FIG. 1, and form openings of rectangular cross-section, similar to the respective first tool insertion holes 48, as shown in FIG. 8. Bottomed cuts 55 having a concave cross-section are open at positions corresponding to the respective second tool insertion holes 56 on an outer surface of the tubular portion 49 facing a vertically central side. Each cut 55 coaxially communicates with each second tool insertion hole 56 in the front-rear direction, and the inner surface of each cut 55 is connected substantially horizontally to the inner surface of each second tool insertion hole 56 without any step.

An unillustrated tool is inserted into each second tool insertion hole 56 from front. The tool comes into contact with the second locking lance 21 via the second opening portion 25 from the second tool insertion hole 56 and is operated for unlocking so that the second locking lance 21 is unlocked from the second male terminal 80 and the second male terminal 80 can be withdrawn rearwardly from the second cavity 14. A tool also is inserted into each first tool insertion hole 48 and operates in the same manner as above to unlock the first locking lance 15. Of course, in the above case, since each cut 55 communicates with each second tool insertion hole 56, the tool can be brought into contact with a recessed surface of the cut 55 of the tubular portion 49 and twisted and strength sufficient to withstand a twisting movement of the tool and the like can be provided.

Next, functions and effects of this embodiment are described.

In assembling, the first male terminal 70 is inserted and accommodated into each first cavity 13 of the housing body 11 from behind, and the second male terminal 80 is inserted and accommodated into each second cavity 14 of the housing body 11 from behind. In this way, each first tab 72 is arranged to project into the receptacle 12 through the opening of the first cavity 13 of the front surface 17 and each second tab 82 is arranged to project into the receptacle 12 through the opening of the second cavity 14 of the front surface 17.

As shown in FIG. 1, when the moving plate 40 is held at the initial position IP in the receptacle 12, the projecting tip of each first tab 72 is positioned in each first hole 43 of the plate body 41 and the projecting tip of each second tab 82 is positioned in each second hole 44 through the tubular portion 49 of the plate body 41. At this time, the projecting tip of each second tab 82 is guided in the lateral direction, which is the width direction, by the succeeding guiding portions 53 of each second hole 44 after being inserted and guided in the vertical direction, which is the thickness direction, by the preceding guiding portions 54 of the tubular portion 49. That is, each second tab 82 is guided into the corresponding second hole 44 in different directions in a stepwise or gradual manner.

Subsequently, the mating housing 90 is fit shallowly into the receptacle 12. When the lever 60 is rotated in that state, the mating housing 90 is fit deeply into the receptacle 12. Further, the moving plate 40 is pressed by each cam follower 92 and moves rearward toward the connection position CP together with the mating housing 90. When the moving plate 40 substantially reaches the connection position CP, the plate body 41 is substantially in contact with the front surface 17 of the housing body 11. At this time, the mating housing 90 faces the front surface 17 via the plate body 41, the housings 10, 90 are held in a proper state, and each small female terminal 91 and each first male terminal 70 and each large female terminal 94 and each second male terminal 80 are connected respectively electrically in a proper state as shown in FIGS. 2 and 3.

Further, when the moving plate 40 reaches the connection position CP, the tubular portions 49 are fit into the recesses 23 of the front surface portion 17. At this time, the preceding guiding portions 54 of the tubular portions 49 are arranged to contact along the slopes 24 of the front surface 17. Further, as shown in FIG. 3, the respective interpolar partitioning portions 52 of the tubular portions 49 are arranged between the projecting base end parts of the second tabs 82 adjacent in the lateral direction and coaxially connected to the partition walls 31 between the second cavities 14 in the front-rear direction. At this time, a tip of each interpolar partitioning portion 52 is arranged to contact along the slope 24.

In the case of this embodiment, the second tabs 82 are longer than the first tabs 72 and the recesses 23 are provided in the front surface 17 of the housing body 11 by recessing areas around the openings of the respective second cavities 14 farther rearward than areas around the openings of the respective first cavities 13. Thus, the adjacent second tabs 82 projecting into the recesses 23 may be shorted to each other. However, the interpolar partitioning portions 52 of the moving plate 40 enter the recesses 23 at the connection position CP to partition between the adjacent second tabs 82 and to avoid having the second tabs 82 shorted to each other.

Further, the tubular portions 49 surrounding the openings of the second holes 44 while including the interpolar partitioning portions 52 are provided on the rear surface of the plate body 41. Thus, the interpolar partitioning portions 52 are reinforced by the tubular portions 49 and the breakage, fracture and the like can be prevented. In addition, since the inner surfaces of the second holes 44 and the inner surfaces of the tubular portions 49 are continuous, insertion areas for the second tabs 82 become longer and positioning reliability can be enhanced.

Further, since the tubular portion 49 is in the form of a continuous tube continuously surrounding the openings of the adjacent second holes 44 on the rear surface of the plate body 41, the interpolar partitioning portions 52 are reinforced more strongly.

Further, out of four surfaces constituting the inner surface of the tubular portion 49 and the inner surface of the second hole 44 continuous with the former inner surface, the preceding guiding portions 54 expanded from the intermediate position in the front-rear direction toward the rear end of the tubular portion 49 are provided on two surfaces facing each other in the vertical direction and the succeeding guiding portions 53 expanded from the front end of the second hole 44 toward the intermediate position in the front-rear direction are provided on the other two surfaces facing each other in the lateral direction. Thus, in inserting the second tab 82 into the second hole 44, a two-stage guiding structure composed of the preceding guiding portions 54 and the succeeding guiding portions 53 can be realized. As a result, an impact force (stress) received by the second tab 82 during insertion into the second hole 44 can be dispersed, and the breakage of the relatively long second tab 82 can be prevented.

Furthermore, the second tool insertion holes 56 for the passage of the tool for unlocking the second locking lances 21 locked to the second male terminals 80 are provided in the plate body 41 and the cuts 55 communicating with the second tool insertion holes 56 are provided on the outer surfaces of the tubular portions 49. Thus, the tool can contact and support the tubular portion 49 via the cut portion 55 and strength necessary at the time of unlocking the locking lance can be ensured.

Other embodiments of the invention are described briefly.

The interpolar partitioning portions may partition between the adjacent second male terminals projecting from the peripheral wall of the moving plate.

The tubular portion may not be in the form of a continuous tube and tubular portions may be arranged side by side to individually correspond to the opening peripheral parts of the respective second holes.

The interpolar partitioning portions may not be parts of the tubular portion, but may independently project from a front wall portion or a peripheral wall portion of the moving plate.

The moving plate may not necessarily be moved in conjunction with the rotational movement of the lever.

The preceding guiding portions may be provided on both left and right sides of the inner surface of the tubular portion and the succeeding guiding portions may be provided on both upper and lower sides of the inner surface of the second hole.

Second cavities may be arranged in the vertical direction. In this case, the second male terminals accommodated in the respective second cavities are adjacently arranged in the vertical direction.

The present invention is applicable also to connectors including no lever and/or non-waterproof type connectors.

REFERENCE SIGNS

10 . . . housing
11 . . . housing body
12 . . . receptacle
13 . . . first cavity
14 . . . second cavity
15 . . . first locking lance
17 . . . front surface portion
21 . . . second locking lance
23 . . . recess
40 . . . moving plate
41 . . . plate body
43 . . . first hole
44 . . . second hole
49 . . . tubular portion
52 . . . interpolar partitioning portion
53 . . . succeeding guiding portion
54 . . . preceding guiding portion
55 . . . cut
56 . . . second tool insertion hole
70 . . . first male terminal
72 . . . first tab
80 . . . second male terminal
82 . . . second tab
90 . . . mating housing

What is claimed is:

1. A connector, comprising:

first male terminals each including a first tab;

second male terminals each including a second tab longer than the first tab;

a housing body including first cavities accommodating the respective first male terminals, second cavities accommodating the respective second male terminals, and a front surface, front ends of the first cavities and the second cavities being open in the front surface portion;

a receptacle projecting forward from the housing body and collectively surrounding the first tabs and the second tabs projecting forward from the front surface, the receptacle being configured for receiving a mating housing; and a moving plate including a plate body to be arranged to at least partly cover the front surface in the receptacle, first holes and second holes provided in the plate body for receiving the first tabs and the second tabs, the moving plate being configured to move toward the front surface from an initial position to a connection position;

at least one recess formed in the front surface of the housing body around openings of the second cavities and being recessed farther rearward than areas around openings of the first cavities; and at least one partitioning portion provided on the moving plate and partitioning between the second tabs by entering the recess at the connection position.

2. The connector of claim 1, wherein at least one tubular portion projects on a rear surface of the plate body surrounding opening peripheral parts of the second holes and including the partitioning portion.

3. The connector of claim 2, wherein the tubular portion is a continuous tube continuously surrounding the opening peripheral parts of the second holes on the rear surface of the plate body.

4. The connector of claim 2, wherein second guiding portions provided on two opposed surfaces of the tubular portion and being expanded from an intermediate position in the front-rear direction toward a rear end, and first guiding portions provided on other two surfaces substantially facing each other and expanded from a front end of the second hole toward an intermediate position in the front-rear direction.

5. The connector of claim 2, wherein the housing body is provided with second locking lances configured to position the second male terminals by at least partly projecting into the respective second cavities, the plate body is provided with second tool insertion holes for passage of a tool for displacing the second locking lances from the second male terminals.

6. The connector of claim 5, further comprising cuts provided on an outer surface of the tubular portion and communicating with the second tool insertion holes.

7. The connector of claim 1, further comprising a slope provided on an opening edge part of the second cavity and inclined rearward toward an outer side.

* * * * *